United States Patent [19]

Buchanan

[11] 3,990,672

[45] Nov. 9, 1976

[54] CONCRETE COLUMN FORM

[75] Inventor: Michael S. Buchanan, Johnson City, Tenn.

[73] Assignees: C. O. Buchanan, Johnson City, Tenn.; James L. Hetherwick, Sylvania, Ohio ; part interest to each

[22] Filed: Jan. 27, 1975

[21] Appl. No.: 544,374

[52] U.S. Cl. ..... 249/48; 249/139; 249/164

[51] Int. Cl.[2] ..... E04G 13/02

[58] Field of Search ..... 249/48–49, 249/100, 134, 139, 164, 160, 189; 425/4, 817; 220/9 F

[56] References Cited

UNITED STATES PATENTS

| | | | |
|---|---|---|---|
| 386,979 | 7/1888 | Haase | 249/100 |
| 881,183 | 3/1908 | Guyer | 249/48 |
| 1,050,816 | 1/1913 | Deslauriers et al. | 249/49 |
| 1,054,353 | 2/1913 | Keewan | 249/100 |
| 1,220,083 | 3/1917 | Fouse | 249/48 |
| 1,299,739 | 4/1919 | Landwehr | 249/48 |
| 1,398,412 | 11/1921 | Barkschat | 249/48 |
| 2,602,469 | 7/1952 | Whiting | 249/100 |
| 3,160,307 | 12/1964 | Morrison | 220/9 F |
| 3,350,049 | 10/1967 | Reiland | 249/48 |
| 3,751,196 | 8/1973 | Cannon et al. | 249/48 |

FOREIGN PATENTS OR APPLICATIONS

| | | | |
|---|---|---|---|
| 1,513,315 | 1/1968 | France | 249/48 |

*Primary Examiner*—Francis S. Husar
*Assistant Examiner*—John McQuade
*Attorney, Agent, or Firm*—Allen D. Gutchess, Jr.

[57] ABSTRACT

A portable, reusable concrete form is set forth. At least two substantially identical wall sections have inner walls cooperating with one another to form an elongate cavity of desired transverse cross-sectional shape, being that of the concrete product to be formed. Each of the wall sections also has an outer wall with connecting walls spacing the outer walls from the inner walls, to form elongate spaces therebetween which are filled with insulating material. This enables the concrete to be poured in colder weather than otherwise. The wall sections also have cooperating means for enabling the inner walls to be positioned in registry and the sections have means for releasably holding them in assembled relationship when the concrete is poured. The form also preferably includes a base member which holds the lower ends of the wall sections in position and an upper collar member which helps to hold the upper ends of the wall sections in position.

8 Claims, 23 Drawing Figures

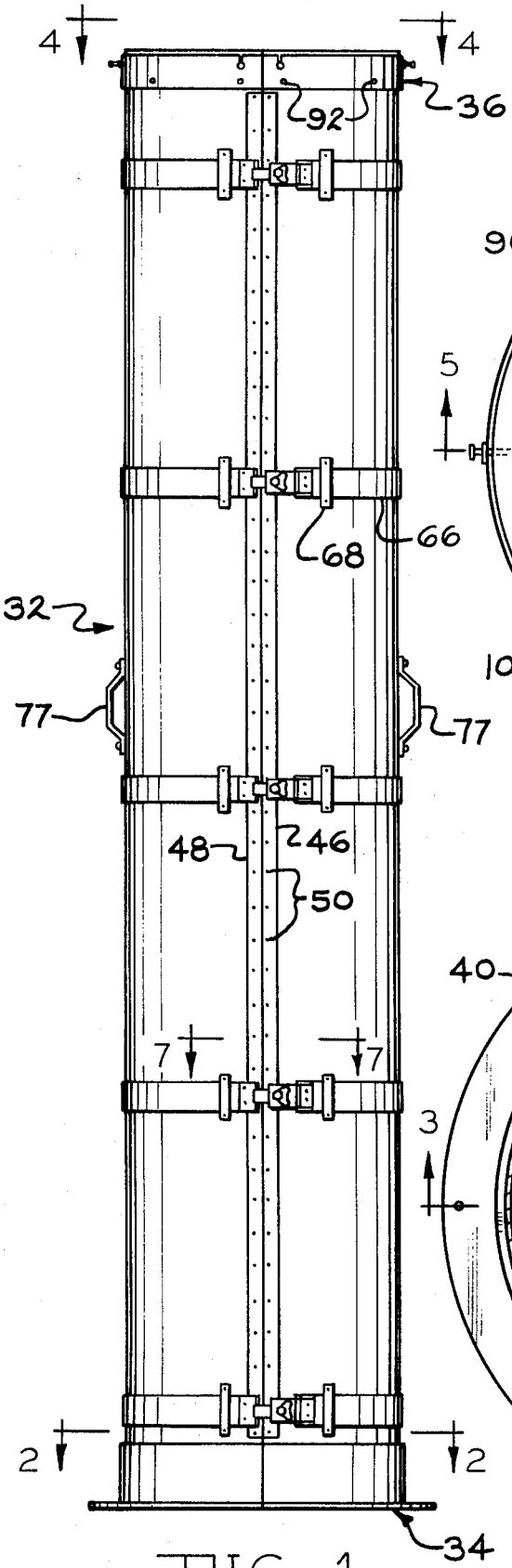
FIG. 1
FIG. 4
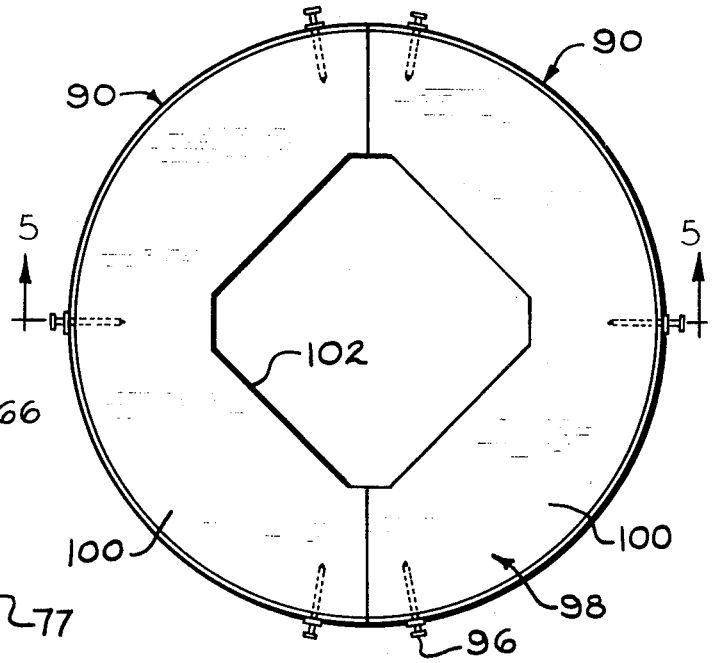
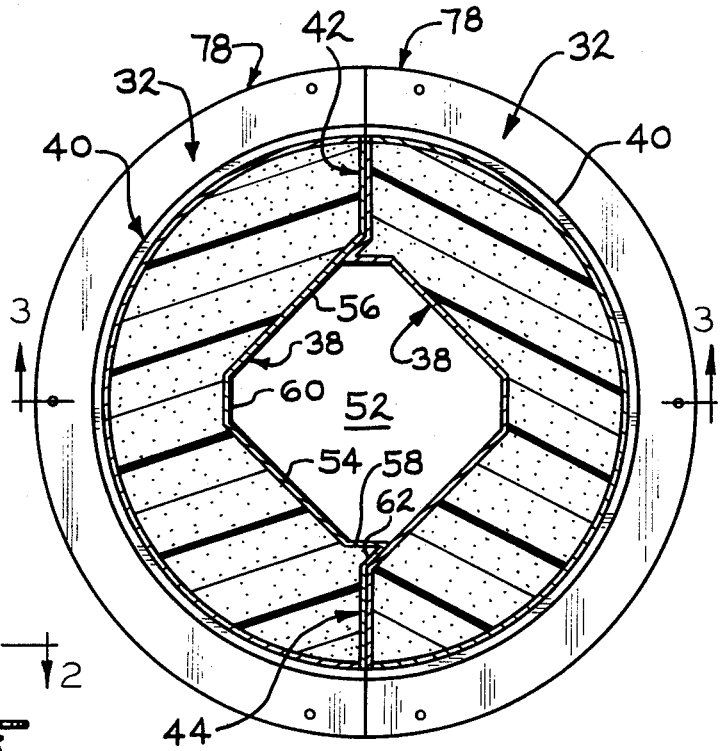
FIG. 2

FIG. 20
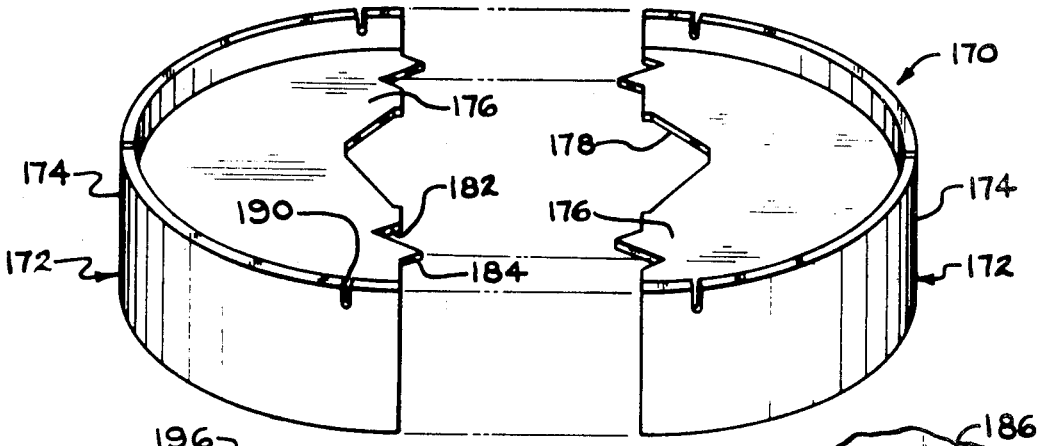
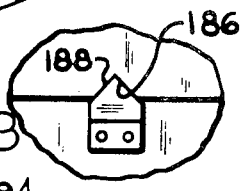
FIG. 23
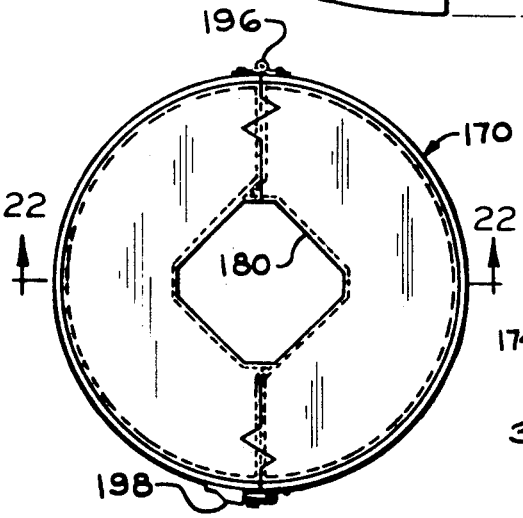
FIG. 21
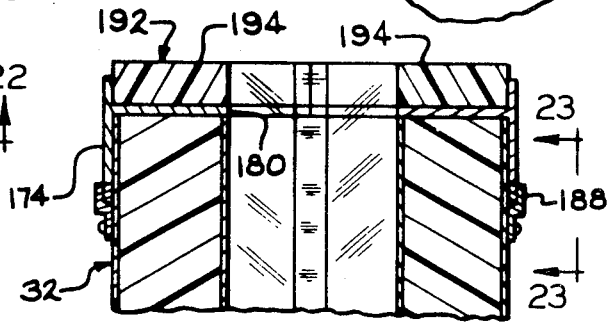
FIG. 22
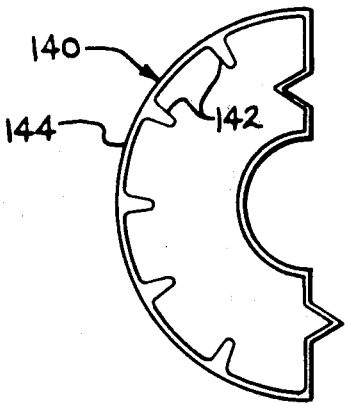
FIG. 17
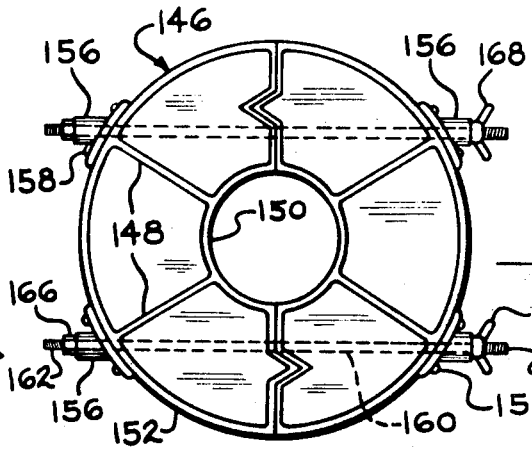
FIG. 18
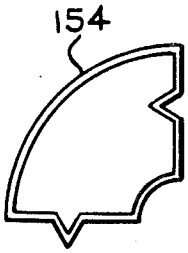
FIG. 19

CONCRETE COLUMN FORM

This invention relates to a concrete form and particularly a form which is portable and reusable.

The present invention provides a portable, reusable concrete form having a number of advantages over forms heretofore known. The new form reduces labor substantially, particularly in comparison with conventional forms, with the time required in erecting and stripping the forms being reduced as much as 60 to 70%. The new concrete form also is simple and requires only standard erector tools. The new form also comprises only a few basic components to reduce the total amount of materials and inventory required at the job site. In addition, the form is insulated so that concrete can be poured in colder weather and without the necessity for applying temporary heat for the pour. The new form also permits assembly and disassembly in areas having restricted ceiling heights and the form can be even cut on the job with conventional power or hand saws for special heights. The form also enables the pre-erection of the rebar columns and the form can also be adapted easily to columns with capitols.

The new concrete form has two or more wall sections which preferably are identical, each section having an inner wall cooperating with another inner wall to form an elongate cavity of desired cross-sectional size and shape, and an outer wall spaced from the inner one by connecting walls, with the space therebetween filled with an insulating material. The form also includes a sectionalized base of two or more sections which fit together around the assembled rebar column and have flanges through which the base sections are nailed or otherwise affixed to the concrete floor. The base sections form an opening of the same size and shape as the elongate cavity and the sections also preferably have bottom walls around the opening which slope toward a common center line to help align the wall sections with the base and to facilitate assembling and disassembling the base sections with the wall sections. The wall sections are also provided with clamping members or other suitable means for releasably holding the wall sections together when the concrete is poured. Further, the form includes a collar located at the upper ends of the wall sections and cooperating with them as well as with a nailable plate which is nailed to plywood panels or other deck members to hold the upper ends of the wall sections in place.

It is, therefore, a principal object of the invention to provide portable, reusable concrete forms having the advantages discussed above.

Many other objects and advantages of the invention will be apparent from the following detailed description of preferred embodiments thereof, reference being made to the accompanying drawings, in which:

FIG. 1 is a view in elevation of a concrete form embodying the invention;

FIG. 2 is a view in transverse cross section taken along the line 2—2 of FIG. 1;

FIG. 4 is a plan view taken along the line 4—4 of FIG. 1;

FIGS. 17–19 are end views of modified form sections;

FIG. 20 is a view in perspective of a modified form component;

FIG. 21 is a plan view of the component of FIG. 20 when in position on form sections;

FIG. 22 is a fragmentary view in vertical section taken along the line 22—22 of FIG. 21; and FIG. 23 is a detailed fragmentary view taken along the line 23—23 of FIG. 22.

Figure 3:
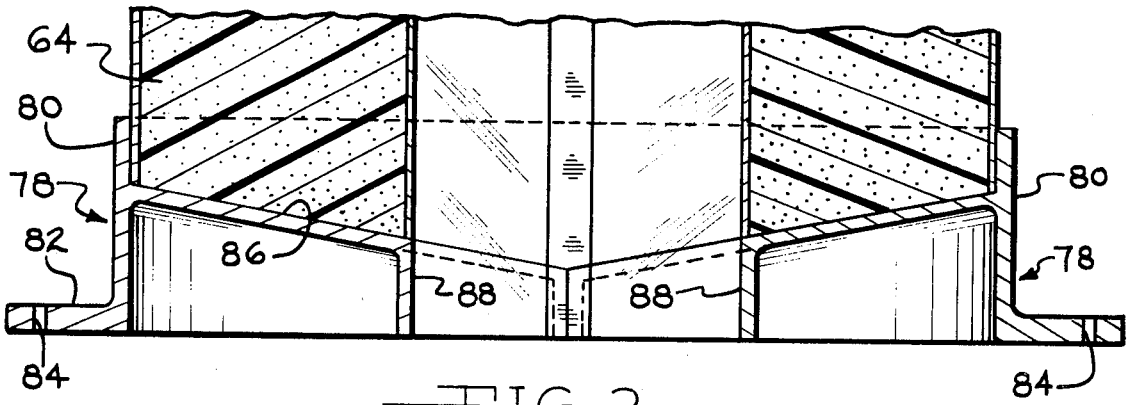
FIG. 3 is a fragmentary view in transverse cross section taken along the line 3—3 of FIG. 2.
Figure 7:
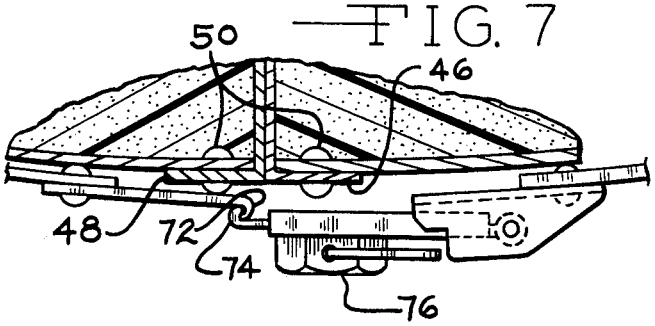
FIG. 7 is a fragmentary view in horizontal cross section taken along the line 7—7 of FIG. 1.

Referring particularly to FIG. 1, a concrete form according to the invention is indicated at 30 and basically includes elongate wall sections 32, a base 34, and an upper collar 36. Referring particularly to FIGS. 2 and 3, the elongate wall sections 32 include inner walls 38, outer walls 40, and connecting walls 42 and 44. By way of example, the inner walls can be of 0.040 inch aluminum, with or without a teflon or other plastic coating, and the outer walls can be of 0.032 inch aluminum. The walls can also be made of plastic, however. As shown, the inner walls 38 and the connecting walls 42 and 44 are of one-piece construction and are connected to the outer walls 32 through flanges 46 and 48 and rivets 50 (FIGS. 1 and 7).

A cavity 52 formed by the inner walls 38, in this instance, is generally square in transverse cross section with the corners beveled. To form this, each of the inner walls 38 has two main planar portions 54 and 56 and two short bevel portions 58 and 60. The connecting walls 44 have short slanted portions 62 which cooperate with edges of the main flat portions 56 to aid in aligning and orienting the inner walls 38 of the two sections 32 to properly form the cavity 52.

In a preferred form, the space defined by the inner walls 38, the outer walls 40, and the connecting walls 42 and 44 is filled with an insulating material 64. This helps to retain the heat generated by the concrete during curing and enables the concrete to be poured in colder weather than otherwise. Further, no preheating of the forms is necessary for cold-weather pouring. The insulating material 64 can be a rigid or semi-rigid plastic foam, which is foamed in situ in the space. Other suitable insulating materials include vermiculite and cement, perlite and cement, crushed polyurethane and an adhesive, a combination of resin and wood fibers, and foamed glass.

Figure 8:
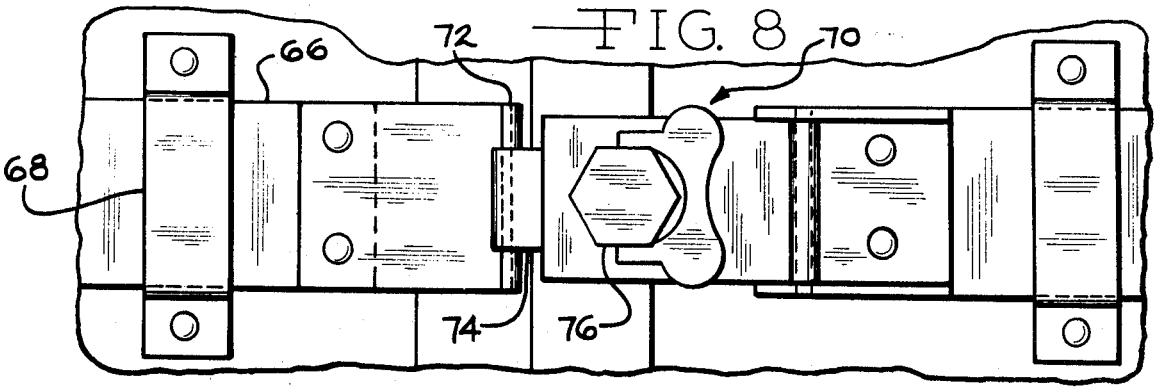
FIG. 8 is a fragmentary front view of the apparatus of FIG. 7.

With the wall sections 32 in their assembled relationship, as shown in FIGS. 1–3, they are releasably held together by suitable means spaced longitudinally along the sections. As shown, each of the sections 32 has a metal band 66 encircling the section substantially from edge to edge and held in position by suitable cross straps 68. The bands are spaced apart in this instance somewhat less than 2 feet and can be of 0.060 inch aluminum or 22-gauge steel, by way of example. The bands can also be of a fabric similar to seat belt material. Further, conventional steel or plastic banding can be employed, which is tightened with conventional banding tools. However, in the embodiment shown (FIGS. 7 and 8), the band ends are connected by a commercially-available catch 70 which includes a stationary hook 72 and a retractable hook 74, the latter being moved in and out by the turning of a wing nut 76. The catch 70 is commercially-available from Simmons Fastner Corporation of Albany, New York and will not be discussed in further detail. When the sections 32 are assembled with the connecting walls 42 and 44 in nesting relationship, the retractable hooks 74 are engaged with the stationary hooks 72 and the wing nuts 76 rotated to retract the hooks 74 and tighten the bands 66. Other suitable catches can be employed in place of the ones shown, including various over-center types. When the wall sections 32 are separated, they can be carried about by means of handles 77 of FIG. 1.

The base 34 preferably includes two substantially identical base sections 78, each of which has an outer semicircular flange 80 which cooperates with the outer wall 40 of the wall section 32. A horizontally-extending mounting flange 82 is integral with the lower edge of the flange 80 and has openings 84 to receive fasteners for affixing the base sections 78 to a concrete floor or other horizontal surface. Each of the base sections 78 also has a sloping bottom wall 86 (FIG. 3) which slopes from the flange 80 to a center line where it matches the bottom wall 86 of the other base section. The bottom ends of the wall sections 32 are similarly sloped to provide mating surfaces to align the wall sections 32 and the base sections 78. The slope also enables the base sections 78 to be removed before the wall sections 32 from a poured concrete body, as will be discussed subsequently. The bottom walls 86 terminate inwardly in inner walls 88 which form an opening of the same size and shape as the transverse cross-sectional size and shape of the cavity 52 formed by the wall sections 32. As shown, the base sections 78 can be aluminum or other metal castings, but can also be solid or cored plastic material.

Figure 5:
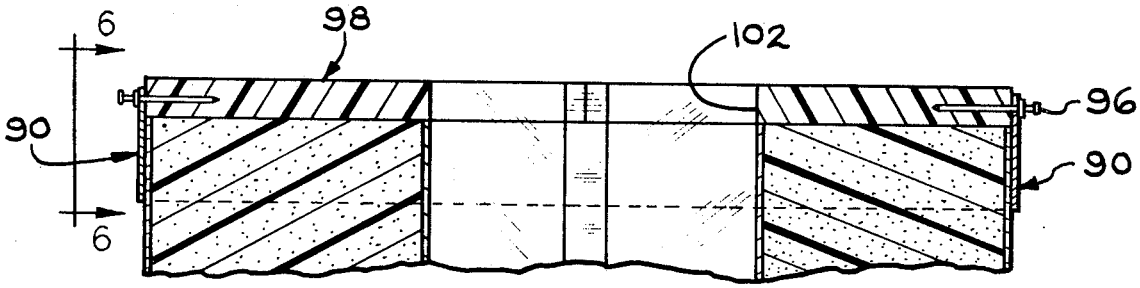
FIG. 5 is a fragmentary view in transverse cross section taken along the line 5—5 of FIG. 4.
Figure 6:
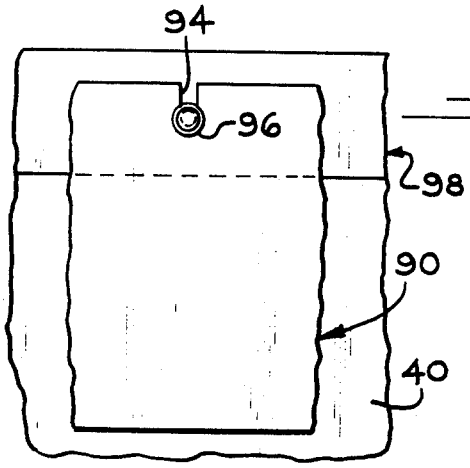
FIG. 6 is a fragmentary view in elevation taken along the line 6—6 of FIG. 5.

The top collar 36 is also shown in FIGS. 4–6. The collar 36 includes two collar sections 90 which extend around the upper ends of the wall sections 32 from one edge to the other and also project upwardly beyond the upper ends of the sections 32. The collar sections 90 can be affixed to the corresponding sections 32 by means such as rivets 92 (FIG. 1) or can be loose. The upper edges of the collar sections 90 have openings, preferably slotted openings 94 therein (FIG. 6), through which nails, preferably double-headed nails 96, are driven into a nailing plate 98. The nailing plate 98 includes two plate sections 100 of the same diameter as the outer walls 40 of the sections 32 and are contoured to form a central opening 102 corresponding in size and shape to the transverse cross-sectional size and shape of the cavity 52. The plate sections 100 can be visually aligned with the sections 32 when put in place and are held by the nails 96. The nailing plate 98 serves to maintain the upper ends of the wall sections 32 in fixed positions, as will be discussed subsequently. The nailing plate 98 can be of wood or of flake or chip board, or can be of a high density urethane foam plastic material. It can also be of a lightweight concrete material such as discussed above with regard to materials suitable for the insulating material.

Figure 9:
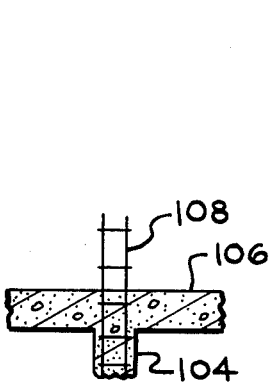
FIGS. 9–15 are schematic, fragmentary views showing a method of pouring concrete using the new form.

The method of using the form 30 and of pouring concrete will now be discussed in connection with FIGS. 9–15. FIG. 9 shows, in cross section, a previously poured concrete column 104 and a previously poured concrete floor 106 which is structurally integral with the column 104, the two being poured at the same time. A rebar assembly 108 extends upwardly through the column and the floor.

Figure 10:
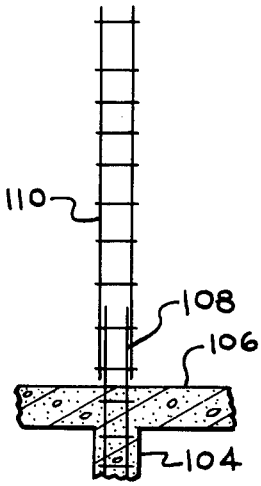
Figure 11:
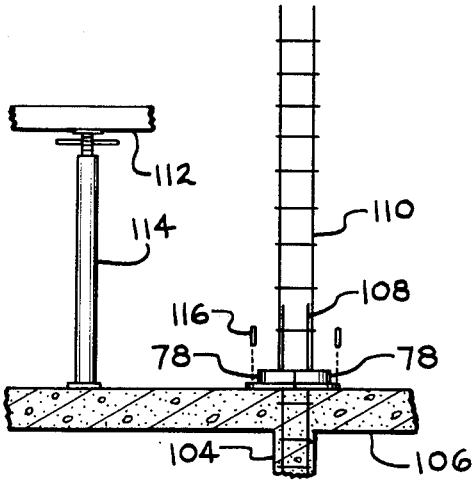

Referring to FIG. 10, another rebar assembly 110 is mounted on the first and is of a height sufficient to extend above the next floor in the same manner as the rebar assembly 108 does with respect to the floor 106. Stringers or timbers 112 (FIG. 11) are then moved into position and supported on shore jacks 114 at suitable spaced intervals. To this point, the construction technique is known in the art. In accordance with the invention, the base sections 78 are then positioned around the rebar assemblies 108 and 110 which extend through the opening 88 in the base sections. The base sections 78 are then affixed to the concrete floor 106 by suitable nails or other fasteners 116 which are driven through the openings 84 in the base sections 78 into the floor.

Figure 12:
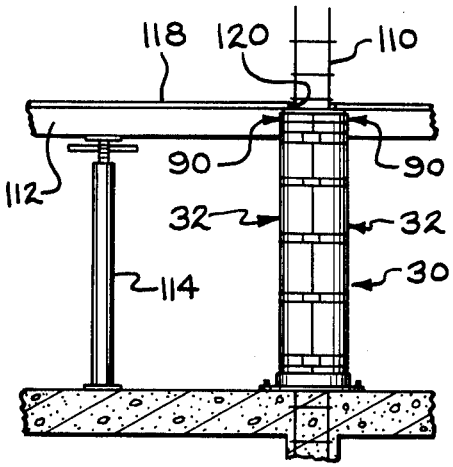

Referring to FIG. 12, the wall sections 32 are then positioned on the base sections 78 and assembled together by means of the catches 70. The collar sections 90 are then placed around the sections 32, if they are not already riveted thereto, and the nailing plate 98 is positioned on the upper ends of the sections 32 and the collar sections 90 are nailed thereto. Plywood decking 118 or other suitable sheet material is supported on the timbers 112. The decking 118 has openings 120 therein to receive the rebar assembly 110 with the opening 120 being similar in shape to that in the nailing plate 98. The decking 118 is then nailed into the plate 98 to hold the upper end of the concrete form 30 in position. The form 30 is thereby firmly in position through the upper nailing plate 98 and the collar 90 along with the base 34. If the decking 118 is installed before the form 30 is positioned, the wall sections 32 with the collar sections 90 and the plate 98 can be assembled around the rebar assembly 110. These can then be raised up against the decking 118 and the base sections 78 then slid into place below the lower ends of the wall sections 32 and affixed to the floor.

Figure 13:
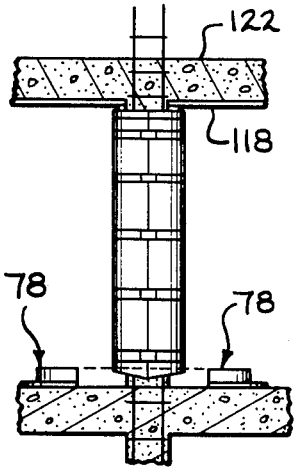
Figure 14:
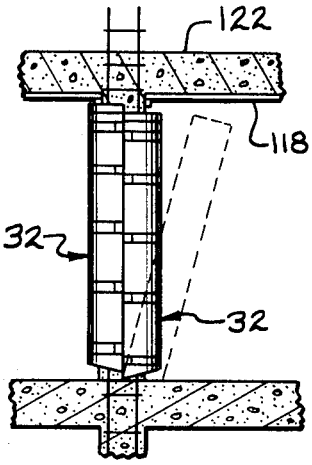
Figure 15:
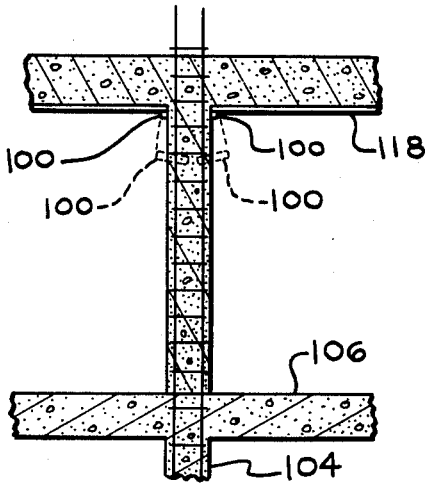

Concrete is then poured into the cavity 52 of the form 30 and, at the same time, an upper concrete floor 122 is poured to form a monolithic structure. When the concrete is sufficiently cured, the form 30 is removed. To accomplish this, the nails or other fasteners 116 are removed from the base 34. The base sections 78 then can be slid outwardly as shown in FIG. 13 due to the sloping configuration of the bottom walls 86 of the base sections 78, as discussed in connection with FIG. 5. The wall sections 32 can then be lowered as shown in FIG. 14 after the double-headed nails 96 in the upper collar 36 are loosened so that the collar will move downwardly with the sections 32 if fastened thereto, while the nailing plate 98 remains in position. The sections 32 are then tilted outwardly, as shown in dotted lines in FIG. 14, and removed. Subsequently, the nailing plate sections 100 can then be pried away from the plywood decking 118, as shown in FIG. 15, to complete the operation.

The concrete form 30 can be removed before the concrete is fully cured, as long as the shore jacks 114 are allowed to remain in load-supporting position. This enables the forms 30 to be moved sooner to another position and reused.

In some instances, the transverse cross-sectional shape of the columns being poured do not render the wall sections suitable for interlocking. For example, sections 124 of FIG. 16 have inner walls 126 which simply form a cavity 128 of circular cross-sectional shape. To aid in aligning the sections 124, outer walls 130 are connected to the inner walls 126 by connecting walls 132 and 134 having nesting V-shaped portions 136 and 138 which provide the proper registry for the sections 124, serving in place of the slanted wall portions 62 of the connecting walls 44 of the sections 32 in FIG. 2.

Figure 16:
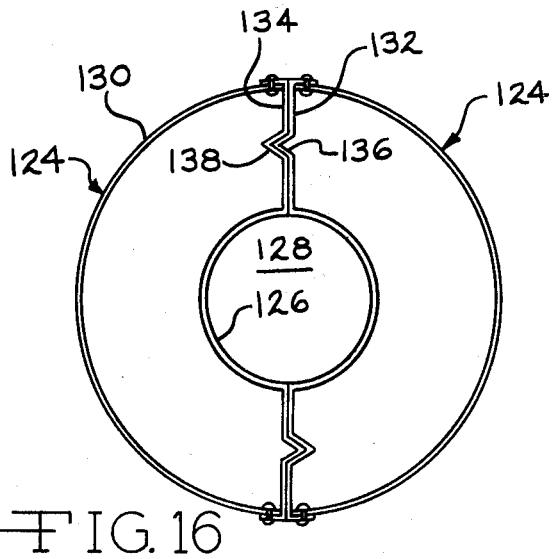
FIG. 16 is an end view of a modified concrete form.

Referring to FIG. 17, a wall section 140 is a metal or plastic extrusion, otherwise being functionally similar to the sections 124 of FIG. 16. In this instance, stiffening ribs 142 can be integrally formed on the interior of an outer wall 144.

In FIG. 18, extruded sections 146 are similar to the section 140 but have connecting ribs 148 extending between inner walls 150 and outer walls 152 for additional strength. The ribs 148 and similar ribs also dissipate heat from the concrete during initial setting. With larger forms, e.g., exceeding 12 inches in diameter, additional ribs should be used for reinforcement and heat dissipation.

In FIG. 19, an extruded section 154 differs principally from the previously discussed sections in that four of the sections 154 are used for one complete concrete form rather than two. This similar section reduces the costs of the extrusion dies. It is also easier to manipulate in tight areas.

FIG. 18 also shows modified means for releasably assembling two of the wall sections such as the wall sections 146. In this instance, brackets 156 are affixed, as by rivets 158, to the outer walls 152 of the sections 146. Suitable rods 160 having threaded ends 162 and 164 extend through the wall sections 146 and the insulation therein, and through the brackets 156. As shown, a nut 166 is threaded on the rod end 162 and bears against the associated bracket 156. A wing nut 168 is turned on the rod end 164 and snugged against the associated bracket 156 to releasably hold the two sections 146 in assembled relationship. The rods can be spaced along the wall sections about the same distance as the catches 70. While the catches 70 can be operated more quickly, the rods 160 and their associated components are less expensive. Of course, the rods 160 and associated components can also be used with the other forms including that of FIG. 1. Also, a clean-out door or panel can be used with the forms, such as those of FIGS. 1 and 18, to remove trash from the base of the column before the pour is made.

Referring to FIGS. 20–23, a modified upper collar 170 is shown. The collar 170 includes two collar sections 172 which are substantially identical. The sections 172 have outer bands or flanges 174 extending downwardly over the upper ends of the wall sections 32 (FIG. 22) and also extend up above the ends of the sections 32. In this instance, the collar sections 172 have horizontally extending portions 176 with central recesses 178 forming an opening 180 which is similar to the transverse cross-sectional shape of the cavity 52. The portions 178 also have notches 182 and projections 184 to orient them relative to one another. These also distribute the load from the nailing plate sections to both of the collar sections 172 when the decking is being nailed to the plate sections. The nailing plate sections, at least in some instances, can be positioned with their meeting line perpendicular to the meeting line of the collar sections 172 to further aid in distributing the load. To assure that the opening 180 is aligned with the cavity 52, lower edges of thhe flanges 174 have notches 186 which are received on projections 188 riveted to the outer walls of the wall sections 32. The flanges 174 also have upper slots or openings 190 to receive nails to fasten the collar sections 158 to a nailing plate 192 which can be similar to the plate 98, being of two sections 194. In this instance, the collar sections 172 are connected by a hinge 196 at one edge and have a catch 198 at the opposite edge. This enables the sections to be placed on the upper ends of the sections 32 and aligned with the projections 188 in minimum time.

Various other modifications of the above-described embodiments of the invention will be apparent to those skilled in the art, and it is to be understood that such modifications can be made without departing from the scope of the invention, if they are within the spirit and tenor of the accompanying claims.

I claim:

1. A portable, reusable, concrete form comprising at least two substantially identical wall sections engaged with one another to form an elongate cavity having a desired transverse cross-sectional shape, means connected to said wall sections for releasably holding said wall sections in their engaged relationship, base means cooperating with common ends of said wall sections, said base means comprising at least two base sections, said base sections having means aligning said base sections with said wall sections, each of said base sections having a sloping bottom wall which slopes downwardly toward a center line of said elongate cavity, said common ends of said wall sections sloping similarly to the sloping bottom walls of said base sections to enable said base sections to be moved outwardly in directions transverse to the center line of said cavity without moving said wall sections, and collar means connected with the opposite ends of said wall sections, said collar means being affixed to plate means by which said collar means can be affixed to a support for holding said opposite ends of said wall sections in a given position.

2. A concrete form according to claim 1 characterized by said base sections having flanges extending outwardly beyond said wall sections and having openings therein to enable said base sections to be affixed to a lower supporting surface.

3. A concrete form according to claim 2 characterized by said aligning means of said base sections being upwardly extending flange means extending upwardly outside said wall sections to align said base sections and said wall sections but to enable said base sections to be moved outwardly.

4. A concrete form according to claim 1 characterized by said collar means being made of at least two collar sections, and means affixing said collar sections to said opposite ends of said wall sections.

5. A concrete form according to claim 1 characterized by said plate means comprising a nailable plate having a central opening therein corresponding in size and shape to the transverse cross-sectional shape of said cavity.

6. A portable, reusable, concrete form comprising at least two elongate wall sections in an assembled relationship having inner walls forming an elongate cavity of desired transverse cross-sectional shape, said wall sections forming outer walls spaced from said inner walls and forming elongate spaces therebetween, said wall sections having common ends sloping downwardly toward the center of the elongate cavity, said wall sections having cooperating means to maintain said inner walls in fixed, aligned relationship when said wall sections are assembled, means connecting said inner and outer walls to maintain them in their spaced relationship, an insulating material in said spaces, means located along said wall sections for releasably holding said wall sections in their assembled relationship, at least two base sections having flange means cooperating with said wall sections to align said base sections and said wall sections, said base sections having sloping bottom walls lying contiguous with said ends of said wall sections to enable said base sections to be moved transversely outwardly from said wall sections in directions perpendicular to the centerline of said elongate cavity.

7. A concrete form according to claim 6 characterized by said spaces having elongate ribs connected between said inner walls and said outer walls and effective to dissipate heat from the concrete in the cavity during initial setting thereof.

8. A concrete form according to claim 6 characterized by a collar located around the other ends of said wall sections and extending beyond said ends, and means on said wall sections for aligning said collar with said wall sections.

* * * * *